United States Patent [19]

Cahill

[11] Patent Number: 4,629,441

[45] Date of Patent: Dec. 16, 1986

[54] FABRIC DOLL FACE WITH STUFFED FEATURE, AND METHOD

[76] Inventor: Mary J. Cahill, 6929 Marlborough Ave., Goleta, Calif. 93117

[21] Appl. No.: 610,959

[22] Filed: May 16, 1984

[51] Int. Cl.[4] ..... A63H 3/02; A63H 3/36

[52] U.S. Cl. ..... 446/372; 112/403; 112/420; 156/61; 156/63; 156/291; 428/102; 446/392; 446/395

[58] Field of Search ..... 446/369, 370, 371, 372, 446/373, 374, 375, 376, 382, 383, 384, 385, 389, 390, 391-395; 112/266.1, 403, 405, 439, 440, 441, 420; 428/16, 102; 156/291, 61, 63, 268, 292

[56] References Cited

U.S. PATENT DOCUMENTS

| | | | |
|---|---|---|---|
| 144,373 | 11/1873 | Walker | 446/268 |
| 285,448 | 9/1883 | Wellington | 222/613 |
| 366,730 | 7/1887 | Johnson | 446/369 |
| 505,679 | 9/1893 | Smith | 446/369 |
| 1,194,521 | 8/1916 | Loeb | 112/266.1 |
| 1,442,761 | 1/1923 | Beach | 446/372 |
| 1,790,872 | 2/1931 | McBee | 446/372 |
| 1,916,811 | 7/1933 | Schwartz | 92/140 |
| 1,924,935 | 8/1933 | Klein | 112/405 |
| 1,948,803 | 2/1934 | Sherrill | 446/372 |
| 2,078,809 | 4/1937 | Richman | 446/74 |
| 2,307,523 | 1/1943 | Maisel | 446/391 |
| 2,483,325 | 9/1949 | Sanders . | |
| 2,577,236 | 12/1951 | Doherty | 428/102 X |
| 2,629,195 | 2/1953 | Casha | 112/420 X |
| 2,805,428 | 9/1957 | Buchman | 5/442 |
| 2,845,749 | 8/1958 | Mickam | 446/392 |
| 3,065,568 | 11/1962 | Reiss | 446/372 |
| 3,463,692 | 8/1969 | Brunner | 156/306.6 |
| 3,567,567 | 3/1971 | Sherrill | 428/196 X |
| 3,575,750 | 4/1971 | Sakamoto | 156/66 |
| 3,619,323 | 11/1971 | Stebelton | 156/292 |
| 3,649,427 | 3/1972 | Hughes | 428/102 |
| 3,658,632 | 4/1972 | Chandler et al. | 428/296 |
| 3,666,604 | 5/1972 | Coffet | 428/81 |
| 3,758,358 | 9/1973 | Kuroda | 156/292 |
| 3,944,454 | 3/1976 | Burgheimer . | |
| 4,211,807 | 7/1980 | Yazawa | 156/291 |
| 4,390,595 | 6/1983 | Kopp | 156/291 |

FOREIGN PATENT DOCUMENTS

| | | |
|---|---|---|
| 2091132 | 7/1982 | United Kingdom . |
| 2104441 | 3/1983 | United Kingdom . |

OTHER PUBLICATIONS

Soft Darlin' Dolls (1983), pp. 1-3.

Foster Children ® Soft Sculpture Dolls, by E. L. Foster.

*Primary Examiner*—F. Barry Shay

*Attorney, Agent, or Firm*—Koppel & Harris

[57] ABSTRACT

The doll of the present invention is formed by outlining a desired feature with an adhesive such as a meltable, fuser thread between a front and rear piece of fabric in an outline of the desired feature such as the nose or mouth. After the adhesive is made to hold the two sheets of fabric together, soft material is inserted between the two sheets within the feature. The outline of a nose is U-shaped, and soft material can be inserted through the top opening between the two pieces of fabric. The outline of a mouth is closed so the soft material is pushed through a slit in the rear piece of fabric. The mouth can also be formed by satin-like stitches in which long stitches are formed on the top of the front sheet of material extending from the outline of the mouth or lips. The soft material is inserted through the rear sheet to cause the front sheet and the satin stitches to bulge outward. The lips can also be formed by running stitches forming an outline, which is then filled. Satin-like stitches then cover the protruding lips. Eyes are formed by stitching the front and rear sheet together next to the nose. The space between the two sheets at the forehead, cheeks and chin is then filled with more soft material, the front and rear sheets of material are sewn together, the face portion is attached to a back head portion, and the cavity between them is filled with soft material. A small sheet of rigid material can also be inserted between the face and the back piece to add rigidly to the doll. The eye locations are stitched with long stitches extending through the back piece and pulled tightly to indent the eyes.

12 Claims, 12 Drawing Figures

FABRIC DOLL FACE WITH STUFFED FEATURE, AND METHOD

BACKGROUND OF THE INVENTION

1. Field of the Invention:

The present invention relates (a) to a method for producing three dimensional facial features on a soft cloth doll and (b) to the doll produced by the method. The method also has applicability for making three dimensional features in cloth other than dolls.

2. The Prior Art:

Soft cloth dolls have been made for centuries. Many methods have been developed to produce facial features. All methods or other similar shaped head cavity made of cloth with a soft substance such as down or fabric. Although there are many methods with slight variations, the methods fall within three categories.

First: Applique and Embedment. Both methods rely on stitching or adhering objects such as buttons, felt scraps, small stuffed and stitched bags, etc. directly on top of (in the case of applique) or embeding them under (in the case of embedment) a seamless facial covering cloth. As an example, some cloth dolls apply a button to the front surface. A button nose is ornamental but artificial. This method has limited results because of the unnatural shape of the embeded or adhered object. Schwartz, U.S. Pat. No. 1,916,811 (1933) is an example of the applique method.

A variation of this method uses pieces of polyester fiberfill and batting glued to a sheet of non-stretch muslin to form gross features such as for a forehead, nose, mouth and cheeks. The muslin and the soft material is covered by a sheet of stretch polyester, and the fiberfill and batting creates gross features. Long stitches can also be pulled completely through the head to provide indentations for the eyes. Use of stitches extending through the head is disclosed in Sanders, U.S. Pat. No. 2,483,325 (1949) and Beach, U.S. Pat. No. 1,442,761 (1923). The resultant faces are interesting, but the facial features are not sharp and life-like because the materials used to form the features cannot be properly confined. Therefore, when the head cover is tightened, the features flatten.

Second: Needle Modeling. Once again, the head is formed by filling with a soft material an approximately spherical or ellipsoidal enclosure of shear, stretch material. The cloth is stitched and tucked into the filling material in such a way as to form three dimensional features. This method is discussed in Foster, *Foster Children Soft Sculpture Dolls,* (1982). The effects produced can be life-like, but the stitches are visible to the unaided eye and are aesthetic distractions. If the material is shear, the head and face has little mechanical durability and can easily be damaged by rough handling. The features formed are less clearly defined if thicker materials are used.

Third: Trapunto. A feature such as an ear is formed by stitching an outline in front and rear cloth pieces. The stitches hold the cloth together. Material is stuffed within the outline between the front and rear pieces to form a protruding feature. Foster, supra mentions this technique. The method is usually unsatisfactory, however, because the stitches are visible.

Fourth: Seamed Heads and Faces. This method uses two or more pieces of pattern material, joined together by stitches to form the head cavity. In the center seamed face, a popular example of this method, a flat pattern is used for cutting two identical side profiles of the head. Each profile has a nose, chin, etc. The profiles are then stitched together with a seam running through the center of the face to create a head cavity, which is then filled with soft material. The seams, which appear directly on the surface of the face, are the main drawback in this system.

Each of the described methods can be used alone or in combination, but they all suffer from an inability to form clear, life-like facial features without distracting stitches on the facial surface. Experts in the field have lamented these drawbacks.

There are some other methods which do not appear to have gained lasting acceptance and are not strictly soft cloth dolls. Walker, U.S. Pat. No. 144,373 (1873) produced facial features pressed from cloth saturated with glue. Wellington, U.S. Pat. No. 285,448 (1883) uses a wire frame inside of the head. Johnson, U.S. Pat. No. 366,730 (1887) used waxed cloth as the base material. Other materials such as tar, paint, pressed felt and cardboard have also been used either to stiffen the material as to form a harder mask or to create a mechanical foundation over which cloth is stretched. None of these masks are soft to the touch, and most are mechanically weak and require technical capabilities often not found in the home.

SUMMARY OF THE INVENTION

The principal objects of the present invention are to disclose and provide a soft doll head with realistic features that can be constructed simply and with materials often found in the home. A further object of the present invention is to disclose and provide a doll that is durable while still retaining its three dimensionality and which can be easily cleaned. A further object is to disclose and provide such a doll that does not have seams through the face. Although the present invention deals primarily with dolls, the invention is also applicable to three dimensional figures on other cloth objects such as clothing.

The present invention relies on three new methods for creating well defined cavities into which material can be added to create facial features. As in earlier methods, the face is formed with two pieces of cloth, and the rest of the head is formed of a third piece of cloth such that the two face pieces and the rear piece form a spherical or ellipsoidal head that is filled with soft material. The methods form features without showing stitching on the doll face.

In one form of the method, an adhesive holds the two face pieces together. The adhesive is placed in the desired outline of the facial feature to create a separate cavity. If part of the feature is open between the two face pieces, soft material can be inserted into the cavity through the open region between the front and rear face pieces. If the feature has no opening, an opening is made in the rear face piece to allow the soft material to be pushed into the cavity outlined by the adhesive. In the exemplary embodiment, this method uses a fuser thread of polyamide or similar substance as an adhesive. The thread is laid out in the defined shape between the two sheets of the face. When heat is applied, the thread fuses the two sheets together along the pattern to create the cavity for stuffing. The fusing holds the two sheets together in a strong manner that is not damaged from rough handling. If the fusing thread is used to define the nose, the strength is enhanced because of strong anchoring in the eyes and mouth areas around the nose that limits the movement of the fabric adjacent the fused outline.

Other features such as the mouth can be formed by the same technique. The present invention, however, uses two new methods to create a three dimensional mouth that also looks embroidered or which is covered by embroidery. This embroidered look is obtained with a stitch similar to a satin stitch but is raised and greatly projected from the surface of the cloth. The outline of the lip is first determined and then using needle and thread, the needle first passes through the fabric toward the outside at the outline of the lip and then the needle is located at the vertically opposite side of the outline of the lip and passed through the fabric toward the inside sheet. The needle is then pulled back through the fabric. Then the needle point is placed adjacent to the thread that has just passed to the inside. Now the needle for a second time passes through the fabric toward the outside so as to repeat the process. As a result, there are now two long, vertically parallel segments of thread running from the top of the lips and then back to the bottom of the lip to create a special satin stitch. As this process is repeated, an embroidery-like pattern is created of parallel threads on the outside piece of fabric with the space between the outline of the lips along the rear piece of fabric being open. A slit is made in the rear piece of fabric between the mouth outline, and soft stuffing material is pushed through the slit to make the mouth three dimensional and covered by the embroidery-like satin stitch. Rather than having the threads run from the top and bottom of the mouth to the center to form lips, they can run from the top of the mouth to the bottom to create a single mouth.

In an alternative embodiment, which provides lips that are very greatly raised from the facial surface, the lips are outlined using stitches as in the trapunto technique. After the lips are filled as in the previous method, the special satin or embroidery stitch is applied over the projecting lips. These stitches cover the stitches that created the outline of the lips.

After the nose and mouth are formed, the two face pieces are integrated with a back piece to form the head, which is filled with soft material. An additional, stiffer piece of canvas-like material can be inserted into the head for rigidity. Long stitches pass from the eye location through the soft material and through the back piece of fabric that forms the back of the head. When these stitches are tightened, the eye locations are pulled back to create a natural indentation. Although the eye stitching will be visible, the stitching itself can be used to form the highlights of the eye such as a reflection or the pupil itself. The remaining decoration of the eye is painted.

The detailed description of the preferred embodiment shows that the invention meets the objects set forth.

BRIEF DESCRIPTION OF THE DRAWINGS

FIG. 8 is similar to FIG. 7 but shows how the eye locations are indented by long threads.

DETAILED DESCRIPTION OF THE PREFERRED EMBODIMENT

The present method uses two pieces of fabric for forming the face of the doll. The first, front piece 10, and the second, rear piece 12, may be of any type of cloth depending on the color and texture objectives of the maker. At will be explained below, feature protrude more if the front piece 10, which will be the outside, visible piece (FIG. 12), is stretch fabric while the rear or inner cloth 12 does not stretch. Both sheets 10 and 12 are elliptical or oval.

Figure 1:
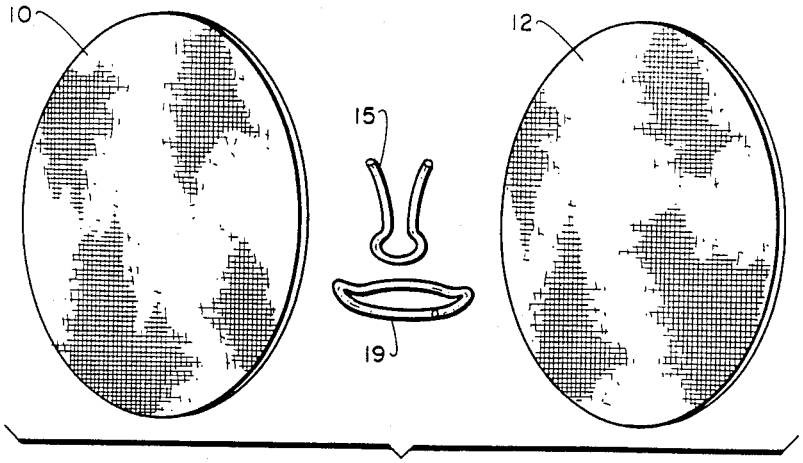
FIG. 1 is an exploded view of the front and rear pieces of fabric in one embodiment of the present invention with fuser thread used to form outlines of the mouth and nose.
Figure 2:
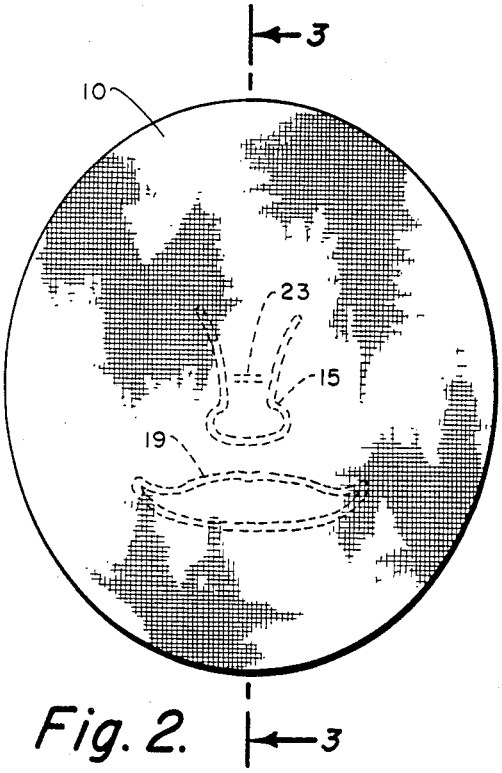
FIG. 2 is an front view showing one embodiment of the present invention.
Figure 3:
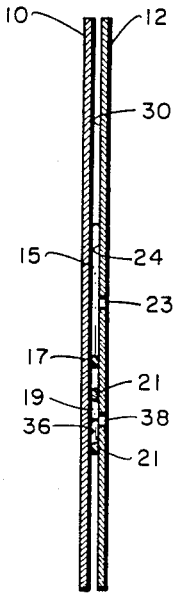
FIGS. 3 and 4 are both cross sectional views taken through plane 3—3 in FIG. 2. Cavities formed by the fuser thread of the exemplary embodiment, which are empty in FIG. 3, are filled in FIG. 4
Figure 4:
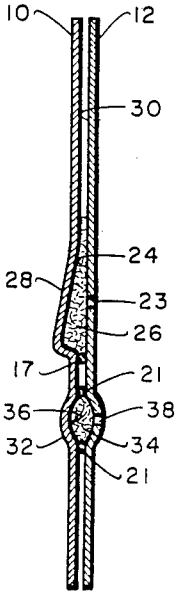
Figure 5:
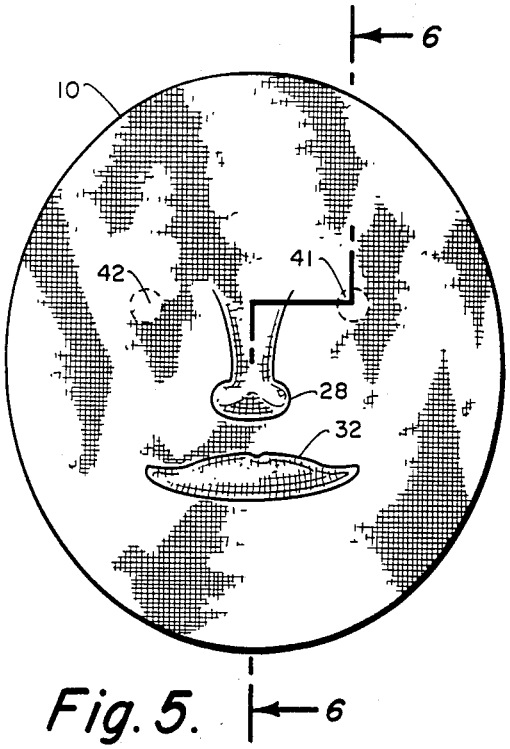
FIG. 5 is a front view of the face in one embodiment of the present invention in which the nose and mouth features are filled and some filling is added to the forehead and chin.

In the embodiment of FIGS. 1 through 8, the nose and mouth are formed in a similar fashion. The construction of the nose is discussed first. The two sheets of fabric 10 and 12, which are approximately the same size, are placed over each other. A desired outline shape for the nose is chosen, and a short piece of fuser thread 15 is made to conform to the desired outline and placed between sheets 10 and 12 at a desired location for the nose, generally near the center of the sheets (FIG. 2). Fuser thread 15 is formed of a polyamide or similar substance, which can be made to conform to any desired shape when it is placed on rear sheet 12. When front piece is then placed over the rear sheet and fuser thread, the thread can then be heated using a clothing iron or other similar device. After several seconds, the fuser thread melts and flows into and around the cloth fibers, which creates a fine fused seam 17 (FIGS. 3 and 4). Likewise, another piece of fuser thread 19 can form the outline of the mouth (FIG. 2), and it can then form hidden, fine fused seams 21 (FIGS. 3 and 4) after it is melted in a similar fashion.

A fuser thread is used because it is easily controlled for adjusting the shape of the features. Only when the feature is in the exact desired shape is heat applied and the final attaching finished. Adhesives that are not set by heating can also be used. Care should be taken so that they are strong and water resistant.

As FIGS. 1 and 2 shows, thread 15 is placed in a pattern, which is a partially closed line. That is, the pattern has a bottom and sides, which are closed, and has an opening at the top. The cavity 24 formed between the front and rear pieces as outlined by the fuser thread 15 is filled with soft material through the opening at the top of the nose. This makes the nose natural in that cavity 24 flows into forehead space 30 (FIGS. 7 and 8), which is also between pieces 10 and 12 and which can also be filled with material to make the forehead. Cheeks (not shown) can be formed to the sides of the nose in a similar fashion.

Instead of filling the nose through the top opening as shown in FIGS. 2 and 3, a small slit 23 can be cut into rear piece 12 within the outline of the nose feature formed by fuser thread 15. Slit 23, which is shown to be horizontal, can also run vertically. Once slit 23 is formed, pocket or cavity 24, which is formed within the outline of seam 17 is filled with soft material such as down 26. As shown in FIGS. 4 and 6 through 8, filled cavity 24 becomes the nose 28 (FIG. 8). For nose 28 to protrude properly, front piece 10 should be of a stretch material, but it is best if rear piece 12 does not stretch so it exerts proper force on filling 26.

Figure 6:
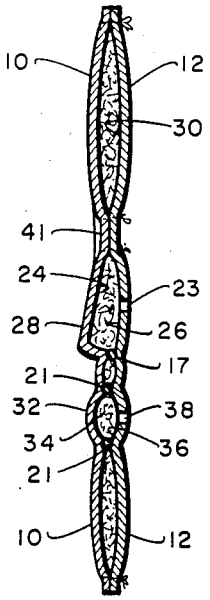
FIG. 6 is a sectional view of the face of FIG. 5 taken on the line 6—6 in FIG. 5.
Figure 7:
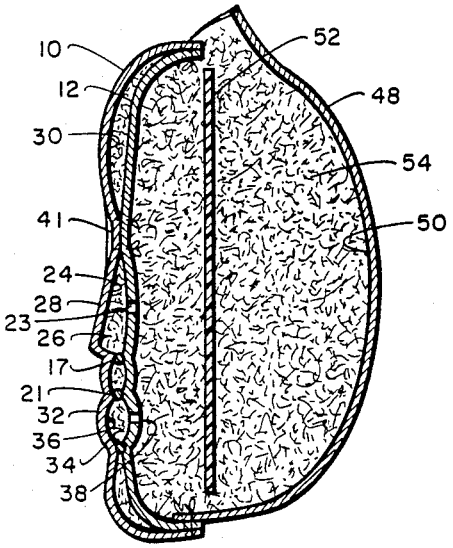
FIGS. 7 and 8 are side, sectional views of the head showing the two filled face pieces attached to the rear head piece, and the entire cavity filled with soft material.
Figure 8:
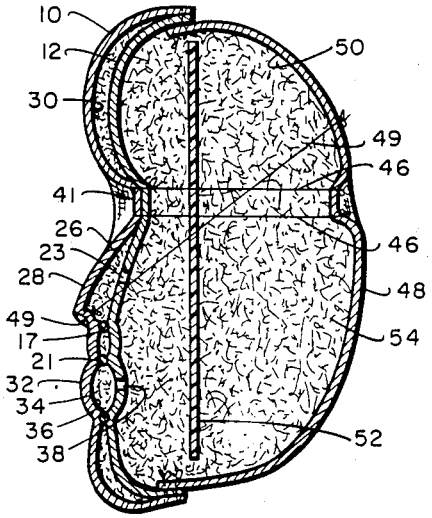

In the first exemplary embodiment, mouth 32 is formed similarly in that soft filling material 34 (FIG. 4) is inserted through slit 38 into cavity 36 between seams 21 made by fuser thread 19 (see also FIGS. 6, 7 and 8).

Using a single outline for the mouth as shown in the exemplary embodiment does not yield separate lips. Painting the central portion of the mouth to create an illusion of separate lips, however, may be acceptable. If not, an additional piece of fuser thread (not shown) can be placed horizontally extending to or near both corners of the mouth. Two cavities, one for each lip, are then formed. These smaller cavities would then be filled using the same techniques.

The eye are next created either by embroidering eye designs or painting the designs at the desired location. Realistic eyes 40 and 41 (FIG. 12) have a white portion 42 and are colored light at iris 43 and dark at pupil 44. Each also has a lighter reflection highlight 45 (FIG. 12), which gives an aesthetic and natural look to each eye. Stitches through the eyes also strengthens the face and helps to hold the front and rear pieces 10 and 12 together. Dark stitching can go through or form pupil 44, and light stitching can be used to create highlights 45.

The face is now held together at four places, attaching means at the two eyes, the adhesive hose, and the mouth 19 or another mouth shown in a second embodiment. The outside periphery of the lower half of the face piece 10 and 12 are now attached together by stitching forming a pocket which is opened at the top but joined at the nose, mouth and eye sockets. Soft material, such as down, fills this large pocket so that a chin, cheeks and forehead naturally appear (FIG. 6). The top periphery of the front and rear piece 10 and 12 are then stitched thus completing the face.

The face is next integrated into the head. The back head piece 48 (FIGS. 7 and 8) is made of a single piece of material cut into an oval or elliptical piece shape. Normally, back head piece 48 will be slightly smaller than front and rear pieces 10 and 12 for a smooth chin formation. First, the bottom periphery of the back head piece 48 is sewn to the bottom periphery of the previously sewn together front and rear piece 10 and 12 so that a head cavity 50 is formed (FIG. 7). An elliptically shaped piece of embroidery canvas 52 or other rigid yet flexible material is placed in cavity 50. Canvas piece 52 generates internal mechanical support for the face, which counters the tendency of such faces to flatten and to lose their life-like and highly contoured appearance. Cavity 50 is then filled with soft material 54 such as down, cotton or synthetic fiberfill until head cavity 50 is filled to the desired firmness. Lastly, head cavity 50 is closed by finishing the stitching along the top portion of the periphery of the back head piece 48 and the front and rear pieces 10 and 12 (FIG. 8). Much of the stitching of the back piece 48 to the front and rear face pieces 10 and 12 takes place with head cavity 50 inside-out so that the stitches and the seam allowances are hidden within the dolls head.

Figure 12:
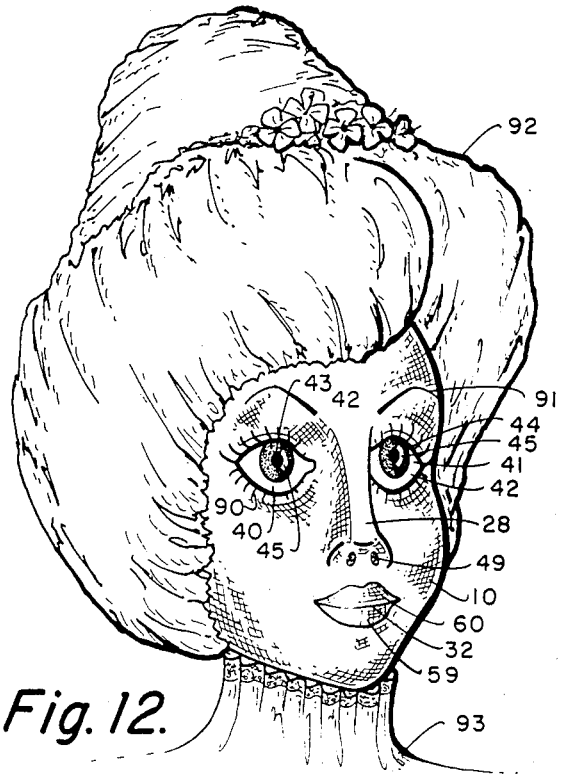
FIG. 12 is a front, perspective view of a decorated doll made using the method of the present invention.

Stitches 46, which help form highlights 45 or pupils 44 (FIG. 12) in eyes 40 and 41 extend through back head piece 48 (FIG. 8) and are pulled tight to make eyes 40 and 41 indent (FIG. 8). For increasing the strength of the nose, one can stitch through the base of the nose and extend through the filling to the rear piece 48. These stitches 49 (FIG. 8) located properly at the bottom of the nose, can look like nostrils (FIG. 12). They do not detract aesthetically from the doll face, but they add to the definition of the bottom of the nose.

Figure 9:
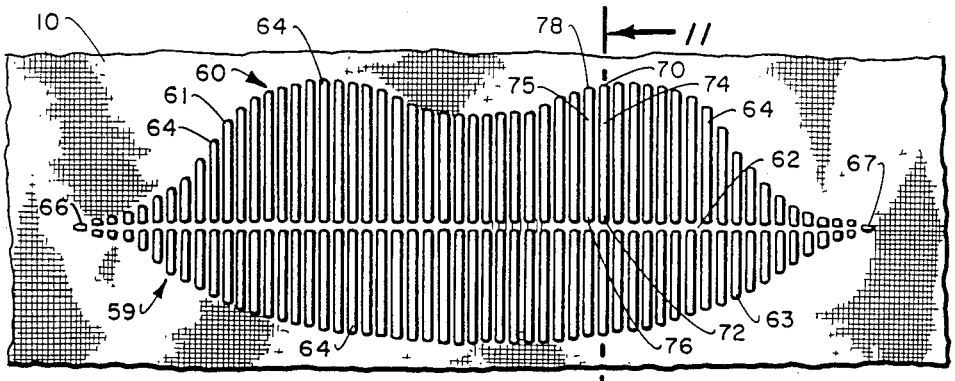
FIG. 9 is a front view showing an alternative method for forming the lips on the doll of the present invention.
Figure 10:
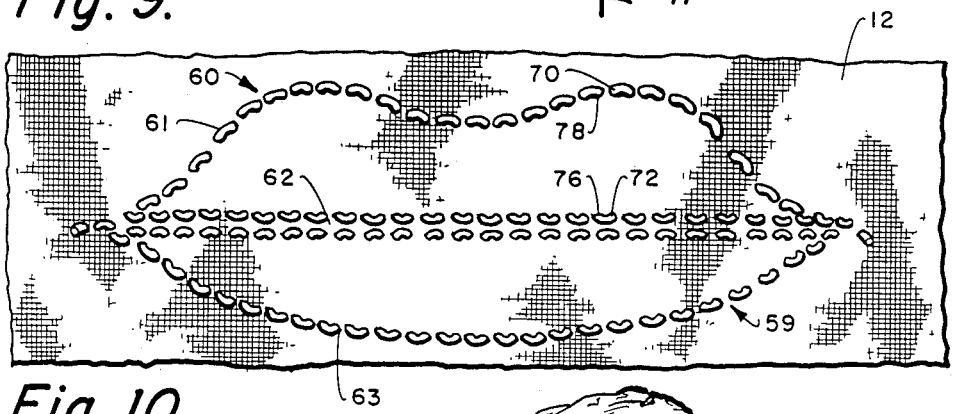
FIG. 10 is a rear view of the alternative method for forming the lips on the doll of the present invention.
Figure 11:
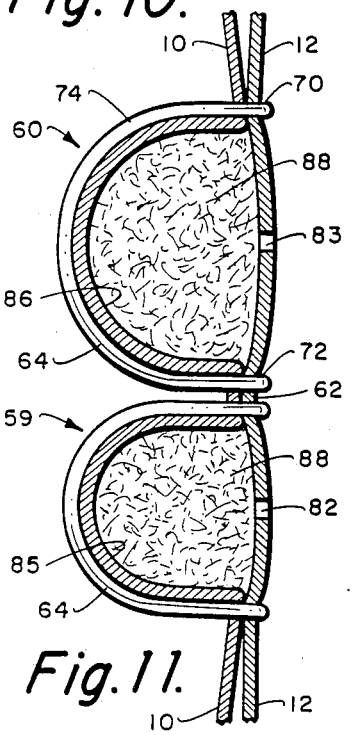
FIG. 11 is a sectional view taken through plane 11—11 in FIG. 9 showing how the lips can be filled to protrude naturally.

The first exemplary embodiment used fuser threads or other adhesives to avoid having stitching on the surface, which would produce aesthetic degredation. The second and third embodiments form the mouth in an aesthetically appealing way without the use of a fuser thread or other adhesive. FIGS. 9, 10 and 11 disclose embodiments using an embroidery-like technique for lip definition and projection. In the first embodiment, which uses fuser threads 15 and 19 for both the nose and mouth, both are placed as desired for fusing simultaneously. In the second and third embodiments, it is preferable to form the nose first by fusion, then to fill the nose and stitch the eye sockets.

Formation of the upper lip 60 in the second embodiment is as follows. Long, special satin stitches 64 (FIG. 9) extend vertically across and cover front piece 10 at the upper lip 60 in the following manner. Although one would most likely start in either the left corner 66 or right corner 67 (FIG. 9), the following discussion will start at location 70 because of the long stitches there. As a result, the corss-section of FIG. 11 is taken at that location. The thread is first passed from the inside (FIG. 10) through rear piece 12 and front piece 10 at location 70 along the upper outline 61 of lip 60. The thread is then brought vertically down to a second location 72 slightly above center-line 62 where the thread is then passed from front to back through front piece 10 and rear piece 12 (FIG. 10) in that order, leaving a long vertical stitch 74 on the front face of front piece 10. When the needle pulling the thread emerges from the back of rear piece 12, it is pushed back through rear cloth 12 and then front cloth 10 at a third location 76 (FIGS. 9 and 10) adjacent to the second location 72. The thread is then pulled vertically up to create a second long stitch 75, which is immediately adjacent the first mentioned long stitch 74. The needle is then passed at fourth location 78 (FIGS. 9 and 10) through front piece 10 and rear piece 12 in that order. The process is repeated until the entire lip is covered with parallel, vertical threads. One end of the thread passes through the fabric along the top outline 61 of upper lip 60, and the other end of the stitch is passed through the fabric slightly above generally horizontal center line 62. Center line 62 can also curve to show a smile or frown.

After upper lip 60 is completed, lower lip 59 is then made using the same special satin stitch techniques and following outline 63 and a line slightly below center line 62. After the stitching is completed for lower and upper lips 59 and 60, slits 82 and 83 are made in the rear piece of fabric 12 (FIG. 11), and cavities 85 and 86 (FIG. 11) are filled with soft filler material 88. Adjusting the tension of long stitches 64 that form the lips 59 and 60 changes the fullness of the lips.

Lips 59 and 60 are shown to be separate. It is possible to eliminate center line 62 and pass long stitches 64 directly from outline 61 of upper lip to outline 63 of lower lip, but this creates merely a protruding mouth without separate lips and is not as realistic.

FIG. 10 also can be used to illustrate the third embodiment. Rather than forming the outline with special satin stitches of FIG. 9, the outline of the lips is formed by using simple running stitches. FIG. 10 would show how the front and rear pieces of fabric 10 and 12 look after the initial outlining. The space within the outline is filled, leaving protruding lips. Lastly, satin stitches similar to those in FIG. 9 or embroidery is made over the protruding lips and covering the outline stitches. This method creates lips that greatly protrude, and the satin stitches hide the running stitches to yield a pleasing appearance.

After the doll head is completed as described, it can be decorated by further painting eye lashes 90 and eyebrows 91 (FIG. 12). A wig 92 or a hat normally is added to the head. Wig 92 covers the seams that attach back head piece 48 to front and rear pieces 10 and 12. The head is then attached to the rest of the doll body 93.

The filled, special satin-stitch techniques just described are useful in dolls, but it can be also used for making soft, protruding features in any type of cloth object.

Various modifications and changes may be made in the configuration described above that come within the spirit of this invention. The invention embraces all such changes and modifications coming within the scope of the appended claims.

I claim:

1. The method of creating a fabric doll face comprising:

(a) attaching a front piece of fabric to a rear piece of fabric with an adhesive between the pieces, the adhesive being in at least one pattern, which is at least partially closed, for outlining a desired feature of the face of the doll and creating a cavity within the pattern of the adhesive between the two pieces of fabric;

(b) pushing soft material into the cavity to push against the front piece of fabric to create the feature;

(c) stitching the two pieces of fabric together at at least one location adjacent the feature;

(d) forming another feature having mutually spaced sides on the front piece and a cavity between the pieces and between the sides by making a series of satin stitches through the front and rear pieces of fabric on the front piece of fabric sufficient to define the surface of the other feature and the outline of the associated cavity; and (e) filling the other feature cavity by inserting soft material beneath the satin stitches between the front and rear pieces of cloth.

2. The method of claim 1, wherein one of the two pieces of fabric is of a stretchable fabric and the other piece of fabric is non-stretchable.

3. A method of creating a fabric doll head, which comprises:

(a) attaching a front piece of fabric to a rear piece of fabric with an adhesive between the pieces, the adhesive being in at least one pattern, which comprises a line that is at least partially closed, for outlining a desired feature of the face of the doll and creating a cavity within the pattern of the adhesive between the two pieces of fabric;

(b) pushing soft material into the cavity to push against the front piece of fabric to create a bulge in the front piece of fabric in the shape of the feature;

(c) attaching the two pieces of fabric together at two locations adjacent the first feature;

(d) attaching the periphery of the front and rear pieces of fabric together;

(e) pushing additional soft material between the two pieces of fabric at locations away from the feature and from the two attached locations to create at least one additional bulge in the front piece of fabric representing a three-dimensional contour of a face;

(f) attaching the completed face along its periphery to a back sheet of fabric along at least a portion of their peripheries to create a head cavity between the face and the back piece of fabric;

(g) filling the space between the back piece of fabric and the face with soft material and closing the remainder of the periphery between the front and rear pieces of fabric and the back piece of fabric to create a doll head.

4. The method of claim 3, wherein one of the two pieces of fabric is of a stretchable fabric and the other piece of fabric is non-stretchable.

5. The method of claim 3 further comprising the step of inserting a generally rigid piece of material between the face and the back piece of fabric with the soft material to add rigidity to the doll head.

6. A method of forming a feature in two pieces of cloth in which a front piece of cloth is on top of a rear piece of cloth, the feature having two sides on the front piece of cloth, the method comprising:

(a) passing the end of a length of thread at a first location through the pieces of cloth from one piece through the other piece on one side of the feature;

(b) passing the end of the thread back through the cloth from the other piece through the one piece at a second location adjacent the first location on said one side of the feature;

(c) passing the end of the thread through the cloth from the one piece through the other piece at a third location on the other side of the feature;

(d) passing the end of the thread through the cloth from the other piece through the one piece at a fourth location adjacent the third location on said other side of the feature;

(e) repeating steps (a) through (d), changing the location of the first and third and second and fourth locations along the sides of the feature to create a plurality of generally parallel threads extending over the feature from the sides of the feature; and (f) inserting soft, bulky material in the space between the front and rear pieces between the sides of the feature to cause the front piece of fabric to protrude under the generally parallel threads.

7. A method of forming a feature in two pieces of cloth in which a front piece of cloth is on top of a rear piece of cloth, the feature having two sides on the front piece of cloth, the method comprising:

(a) forming an outline of the features using a running stitch through the front and rear pieces;

(b) passing the end of a length of thread at a first location through the pieces of cloth from one piece through the other piece on one side of the outline;

(c) passing the end of the thread back through the cloth from the other piece through the one piece at a second location adjacent the first location on said other side of the feature;

(d) passing the end of the thread through the cloth from the one piece through the other piece at a third location on the other side of the outline;

(e) passing the end of the thread through the cloth from the other piece through the one piece at a fourth location adjacent the third location on said one side of the feature;

(f) repeating steps (c) through (f), changing the location of the first and third and second and fourth locations along the side of the feature to create a plurality of generally parallel threads extending over the feature from the sides of the feature; and (g) inserting soft, bulky material in the space between the front and rear pieces between the outline of the feature to cause the front piece of fabric to protrude under the generally parallel threads.

8. A method of forming a feature in two pieces of cloth in which a front piece of cloth is on top of a rear piece of cloth, the feature having an outline with two sides on the front piece of cloth, the method comprising:

(a) attaching the front and rear pieces together about the outline;

(b) inserting soft, bulky material in the space between the front and rear pieces between the sides of the outline of the feature to cause the front piece of fabric to protrude in the shape of the feature; and (c) covering the front piece of fabric over the area between the sides of the outline with satin stitches to form the surface of the feature.

9. A method of creating a face for a fabric doll for use as part of a fabric doll head, the method comprising:

(a) attaching a front piece of fabric to a rear piece of fabric with an adhesive between the pieces, the adhesive being in at least one pattern, which comprises a line that is at least partially closed for outlining a desired feature of the face of the doll and creating a cavity within the pattern of the adhesive between the two pieces of fabric;

(b) pushing soft material into the cavity to push against the front piece of fabric to create a bulge in the front piece of fabric in the shape of the feature;

(c) attaching the two pieces of fabric together at two locations adjacent the first feature;

(d) attaching along the periphery of the front and rear pieces of fabric together; and (e) pushing additional soft material between the two pieces of fabric at locations away from the feature and from the two locations adjacent the feature to create at least one additional bulge in the front piece of fabric representing a three-dimensional contour of the face.

10. The doll head of claim 9 wherein the front piece of fabric is a stretchable fabric and the rear piece of fabric is non-stretchable.

11. A fabric doll head, comprising:

(a) a front piece of fabric and a rear piece of fabric, an adhesive between the front and rear pieces attaching at least respective portions thereof together, the adhesive being in at least one pattern, which comprises a line that is at least partially closed for outlining a desired feature of a face of the doll and creating a cavity within the pattern of the adhesive between the two pieces of fabric;

(b) soft material in the cavity, pushing against the front piece of fabric to create a bulge in the front piece of fabric in the shape of the feature;

(c) attaching means between the front and rear pieces of fabric for holding the pieces together at least two locations adjacent the feature;

(d) attaching means along the peripheries of the front and rear pieces of fabric for holding the peripheries together;

(e) pushing additional soft material between the two pieces of fabric at locations away from the feature and from the attaching means creating at least one additional bulge in the front piece of fabric representing a threedimensional contour of a face;

(f) a back sheet of fabric and back sheet attaching means attaching the completed face along its periphery to the back sheet along at least a portion of the peripheries of the face and the back sheet to create a head cavity between the face and the back piece of fabric;

(g) additonal soft material in the space between the back piece of fabric and the face to create a doll head.

12. A fabric doll face comprising:

(a) a front piece of fabric and a rear piece of fabric, an adhesive between the front and rear pieces attaching at least respective portions thereof together, the adhesive being in at least one pattern, which comprises a line that is at least partially closed for outlining a desired feature of the face of the doll and creating a cavity within the pattern of the adhesive between the two pieces of fabric;

(b) soft material in the cavity pushing against the front piece of fabric to create a bulge in the front piece of fabric in the shape of the feature;

(c) attaching means between the front and rear pieces of fabric for holding the pieces together at at least two locations adjacent the feature;

(d) attaching means along the peripheries of the front and rear pieces of fabric for attaching the peripheries together; and (e) additional soft material between the two pieces of fabric at locations away from the feature and from the attaching means creating at least one additional bulge in the front piece of fabric representing a three-dimensional contour of the face.

* * * * *